US011196145B2

(12) United States Patent
Zachara et al.

(10) Patent No.: US 11,196,145 B2
(45) Date of Patent: Dec. 7, 2021

(54) DIVERSITY ANTENNA FOR BODYPACK TRANSMITTER

(71) Applicant: Shure Acquisition Holdings, Inc., Niles, IL (US)

(72) Inventors: Christopher Zachara, Lake Bluff, IL (US); Christopher Richard Knipstein, Chicago, IL (US); Thomas John Downs, Western Springs, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 16/577,365

(22) Filed: Sep. 20, 2019

(65) Prior Publication Data

US 2020/0021014 A1 Jan. 16, 2020

Related U.S. Application Data

(63) Continuation of application No. 15/187,514, filed on Jun. 20, 2016, now Pat. No. 10,431,873.

(51) Int. Cl.
*H01Q 1/24* (2006.01)
*H01Q 1/27* (2006.01)
(Continued)

(52) U.S. Cl.
CPC ..... *H01Q 1/243* (2013.01); *H01Q 1/273* (2013.01); *H01Q 1/42* (2013.01); *H01Q 1/48* (2013.01);
(Continued)

(58) Field of Classification Search
CPC ..... H01Q 1/243; H01Q 1/273; H01Q 1/42; H01Q 21/28; H01Q 1/48; H01Q 1/50; H01Q 9/0421
See application file for complete search history.

(56) References Cited

U.S. PATENT DOCUMENTS 6,342,860 B1 1/2002 Haussler
2004/0183744 A1 9/2004 Raiman
(Continued)

FOREIGN PATENT DOCUMENTS

CN 1292584 4/2001
CN 102820520 12/2012
GB 2435549 8/2007

OTHER PUBLICATIONS

International Search Report and Written Opinion for PCT/US2017/037524 dated Jan. 12, 2017.
(Continued)

*Primary Examiner* — Dimary S Lopez Cruz
*Assistant Examiner* — Michael M Bouizza
(74) *Attorney, Agent, or Firm* — Neal, Gerber & Eisenberg LLP

(57) ABSTRACT

Embodiments include an antenna assembly comprising a non-conductive housing having an open end; an antenna element positioned inside the non-conductive housing; an electrical cable having a first end electrically coupled to the antenna element and a second end extending out from the open end; one or more dielectric materials positioned inside the non-conductive housing; and a conductive gasket coupled to a portion of the electrical cable positioned adjacent to the open end and outside the non-conductive housing. One embodiment includes a portable wireless bodypack device comprising a frame having a first external sidewall opposite a second external sidewall; a first antenna housing forming a portion of the first sidewall and including a first diversity antenna; and a second antenna housing forming a portion of the second sidewall and including a second diversity antenna.

21 Claims, 9 Drawing Sheets

(51) Int. Cl.

| | |
|---|---|
| ***H01Q 1/42*** | (2006.01) |
| ***H01Q 1/48*** | (2006.01) |
| ***H01Q 1/50*** | (2006.01) |
| ***H01Q 21/28*** | (2006.01) |
| ***H01Q 9/04*** | (2006.01) |

(52) U.S. Cl.
CPC ..... *H01Q 1/50* (2013.01); *H01Q 9/0421* (2013.01); *H01Q 21/28* (2013.01)

(56) References Cited

U.S. PATENT DOCUMENTS

| | | | | |
|---|---|---|---|---|
| 2005/0203583 | A1* | 9/2005 | Twetan | H01Q 1/273 607/36 |
| 2008/0316121 | A1 | 12/2008 | Hobson | |
| 2012/0206302 | A1 | 8/2012 | Ramachandran | |
| 2012/0306721 | A1 | 12/2012 | Okegawa | |
| 2013/0187820 | A1* | 7/2013 | Ng | H01Q 5/371 343/793 |
| 2014/0354510 | A1 | 12/2014 | Li | |
| 2015/0085435 | A1* | 3/2015 | Sakakibara | A63F 13/90 361/679.3 |
| 2015/0171504 | A1 | 6/2015 | Hotta | |

OTHER PUBLICATIONS

Invitation to Pay Additional Fees for PCT/US2017/037524 dated Sep. 21, 2017.

* cited by examiner

DIVERSITY ANTENNA FOR BODYPACK TRANSMITTER

CROSS-REFERENCE

This application is a continuation of U.S. patent application Ser. No. 15/187,514, filed on Jun. 20, 2016, the contents of which are incorporated herein in their entirety.

TECHNICAL FIELD

This application generally relates to portable wireless communication devices, and more specifically, to antennas included in wireless bodypack devices, such as wireless bodypack transmitters and/or receivers.

BACKGROUND

Portable wireless communication devices, such as wireless microphones, wireless audio transmitters, wireless audio receivers, and wireless earphones, include antennas for communicating radio frequency (RF) signals without the need for a physical cable. The RF signals can include digital or analog signals, such as modulated audio signals, data signals, and/or control signals. Portable wireless communication devices are used for many functions, including, for example, enabling broadcasters and other video programming networks to perform electronic news gathering (ENG) activities at locations in the field and the broadcasting of live sports events. Portable wireless communication devices are also used by, for example, stage performers, singers, and/or actors in theaters, music venues, and film studios, and public speakers at conventions, corporate events, houses of worship, schools, and sporting events.

One common type of portable wireless communication device is a wireless bodypack microphone transmitter, which is typically secured on the body of a user (e.g., with belt clips, straps, tape, etc.) and is in communication with a wireless microphone (such as, e.g., a handheld unit, a body-worn device, or an in-ear monitor) and a remote receiver (e.g., an audio amplifier or recording device). Another common type of portable wireless communication device is a wireless bodypack personal monitor receiver, which is also typically secured on the body of the user (e.g., with belt clips, straps, tape, etc.) and is in communication with wireless earphones or other personal monitor (e.g., in-ear monitor, headphones or other headset) and a remote transmitter (e.g., an audio source).

The antennas included in the portable wireless communication devices can be designed to operate in certain spectrum band(s), and may be designed to cover either a discrete set of frequencies within the spectrum band or an entire range of frequencies in the band. The spectrum band in which a portable wireless communication device operates can determine which technical rules and/or government regulations apply to that device.

For example, the Federal Communications Commission (FCC) allows the use of wireless microphones on a licensed and unlicensed basis, depending on the spectrum band. Most wireless microphone systems that operate today use spectrum within the "Ultra High Frequency" (UHF) bands that are currently designated for television (TV) (e.g., TV channels 2 to 51, except channel 37). Currently, wireless microphone users need a license from the FCC in order to operate in the UHF/TV bands (e.g., 470-698 MHz). However, the amount of spectrum in the TV bands available for wireless microphones is set to decrease once the FCC conducts the Broadcast Television Incentive Auction. This Auction will repurpose a portion of the TV band spectrum—the 600 MHz—for new wireless services, making this band no longer available for wireless microphone use. Wireless microphone systems can also be designed for operation in the currently licensed "Very High Frequency" (VHF) bands, which cover the 30-300 MHz range.

An increasing number of wireless microphone systems are being developed for operation in other spectrum bands on an unlicensed basis, including, for example, the 902-928 MHz band, the 1920-1930 MHz band (i.e. the 1.9 GHz or "DECT" band; also included within the 1.8 GHz band), and the 2.4-2.483 GHz band (i.e. "ZigBee" or IEEE 802.15.4; referred to herein as the "2.4 GHz band"). However, given the vast difference in frequency between, for example, the UHF/TV bands and the ZigBee band, wireless microphone systems that are specifically designed for one of these two spectrums typically cannot be repurposed for the other spectrum without replacing the existing antenna(s).

Moreover, antenna design considerations can limit the number of antennas that are included within a single device (e.g., due to a lack of available space), while aesthetic design considerations can restrict the type of antennas that can be used. For example, wireless bodypack transmitters and/or receivers typically include a reduced-size antenna that is at least partially integrated into the bodypack housing to keep the overall package size small and comfortable to use or wear. However, this limitation in antenna size/space makes it difficult for the wireless bodypack device to provide sufficient radiated efficiency and broadband antenna coverage.

Accordingly, there is a need for a wireless bodypack device that can adapt to changes in spectrum availability, but still provide consistent, high quality, broadband performance with a low-cost, aesthetically-pleasing design.

SUMMARY

The invention is intended to solve the above-noted problems by providing systems and methods that are designed to provide, among other things, (1) an antenna assembly configured to fully encase an antenna element within a dielectrically-loaded antenna housing, (2) a portable wireless bodypack device configured to support two separate antenna housings with maximum spatial diversity therebetween, and (3) a process for manufacturing the antenna assembly.

Example embodiments include an antenna assembly comprising a non-conductive housing having an open end; an antenna element positioned inside the non-conductive housing; an electrical cable having a first end electrically coupled to the antenna element and a second end extending out from the open end of the non-conductive housing; one or more dielectric materials positioned inside the non-conductive housing; and a conductive gasket coupled to a portion of the electrical cable positioned adjacent to the open end and outside the non-conductive housing.

Another example embodiment includes a portable wireless bodypack device comprising a frame having a first external sidewall opposite a second external sidewall; a first antenna housing forming a portion of the first external sidewall, the first antenna housing including a first diversity antenna; and a second antenna housing forming a portion of the second external sidewall, the second antenna housing including a second diversity antenna.

Another example embodiment includes a method of manufacturing an antenna assembly for a portable wireless bodypack device. The method includes forming the antenna assembly by depositing a first dielectric material into an open end of an antenna housing comprising an antenna element and at least one additional dielectric material, and coupling a conductive gasket to an electrical cable coupled to the antenna housing, the conductive gasket being coupled adjacent to the open end and outside the antenna housing.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1B:
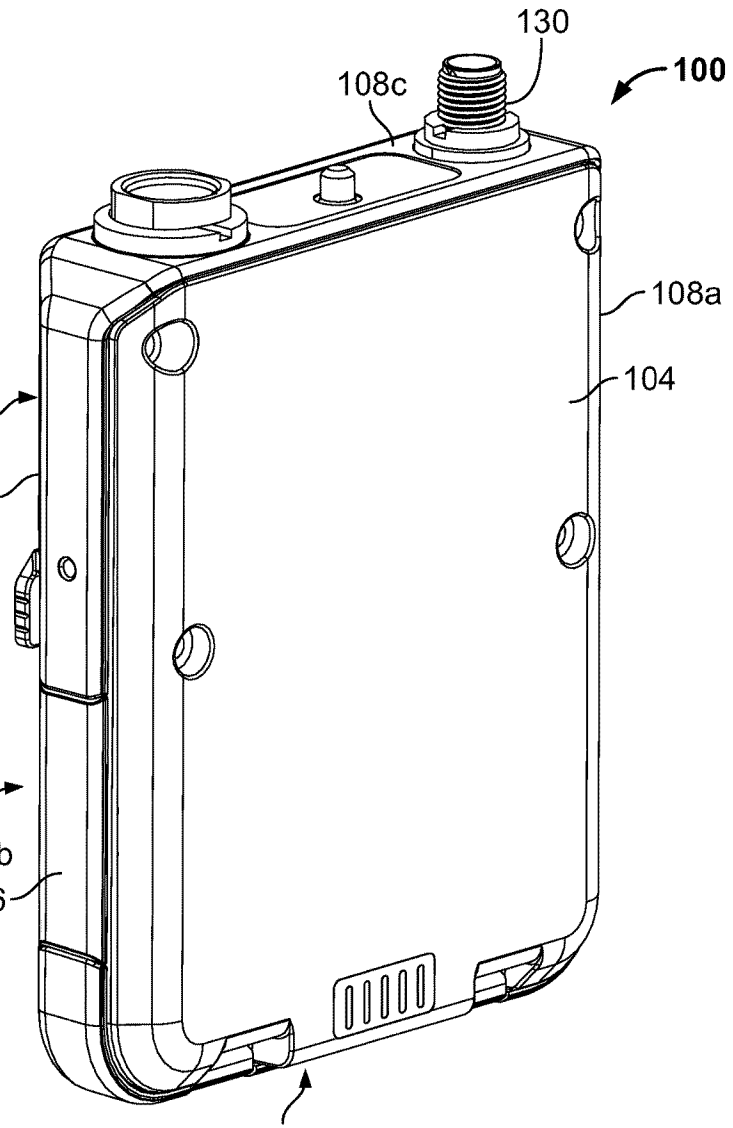
FIG. 1B is a rear perspective view of the portable wireless bodypack device of FIG. 1, in accordance with certain embodiments.

The description that follows describes, illustrates and exemplifies one or more particular embodiments of the invention in accordance with its principles. This description is not provided to limit the invention to the embodiments described herein, but rather to explain and teach the principles of the invention in such a way as to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

With respect to the exemplary systems, components and architecture described and illustrated herein, it should also be understood that the embodiments may be embodied by, or employed in, numerous configurations and components, including one or more systems, hardware, software, or firmware configurations or components, or any combination thereof, as understood by one of ordinary skill in the art. Accordingly, while the drawings illustrate exemplary systems including components for one or more of the embodiments contemplated herein, it should be understood that with respect to each embodiment, one or more components may not be present or necessary in the system.

Figure 1A:
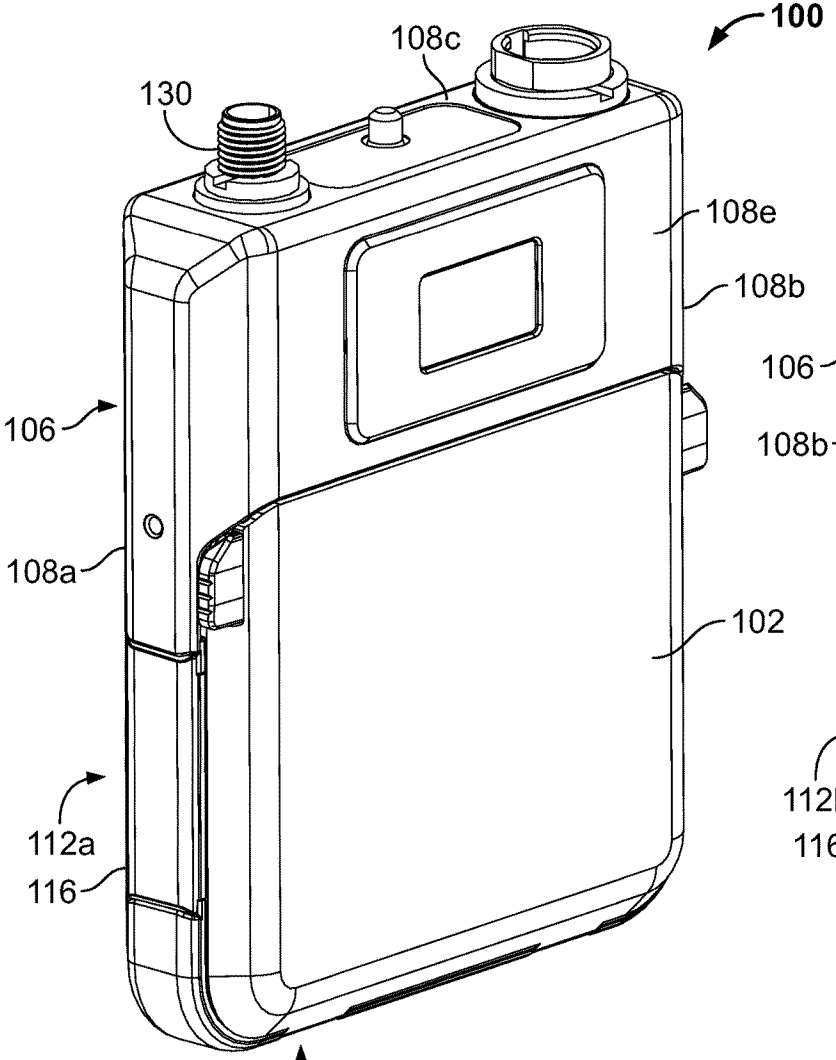
FIG. 1A is a front perspective view of an example portable wireless bodypack device, in accordance with certain embodiments.

FIGS. 1A and 1B depict front and rear perspective views of an example portable wireless bodypack device 100 (also referred to herein as a "bodypack device"), such as, for example, a portable wireless bodypack transmitter for use with a wireless microphone (not shown), in accordance with embodiments. Although the embodiments described herein are explained in the context of a bodypack transmitter, the term "bodypack device" is used herein to include both transmitters and receivers, such as, for example, a portable wireless bodypack receiver for use with a wireless personal monitor.

As illustrated, the bodypack device 100 includes a front cover 102 and a back cover 104 positioned on opposite sides of the device 100 and a frame 106 coupled therebetween. The frame 106 can form left and right external sidewalls 108*a* and 108*b* of the bodypack device 100, as well as top and bottom external sides 108*c* and 108*d* of the device 100. In embodiments, the frame 106 can also extend around a top, front section of the bodypack device 100 to form an upper front surface portion 108*e* of the bodypack device 100. As shown, the upper front surface portion 108*e* can be configured to carry and/or support a display screen and to receive the front cover 102. In such cases, the front cover 102 may form only a lower portion of the front surface of the bodypack device 100.

Figure 2:
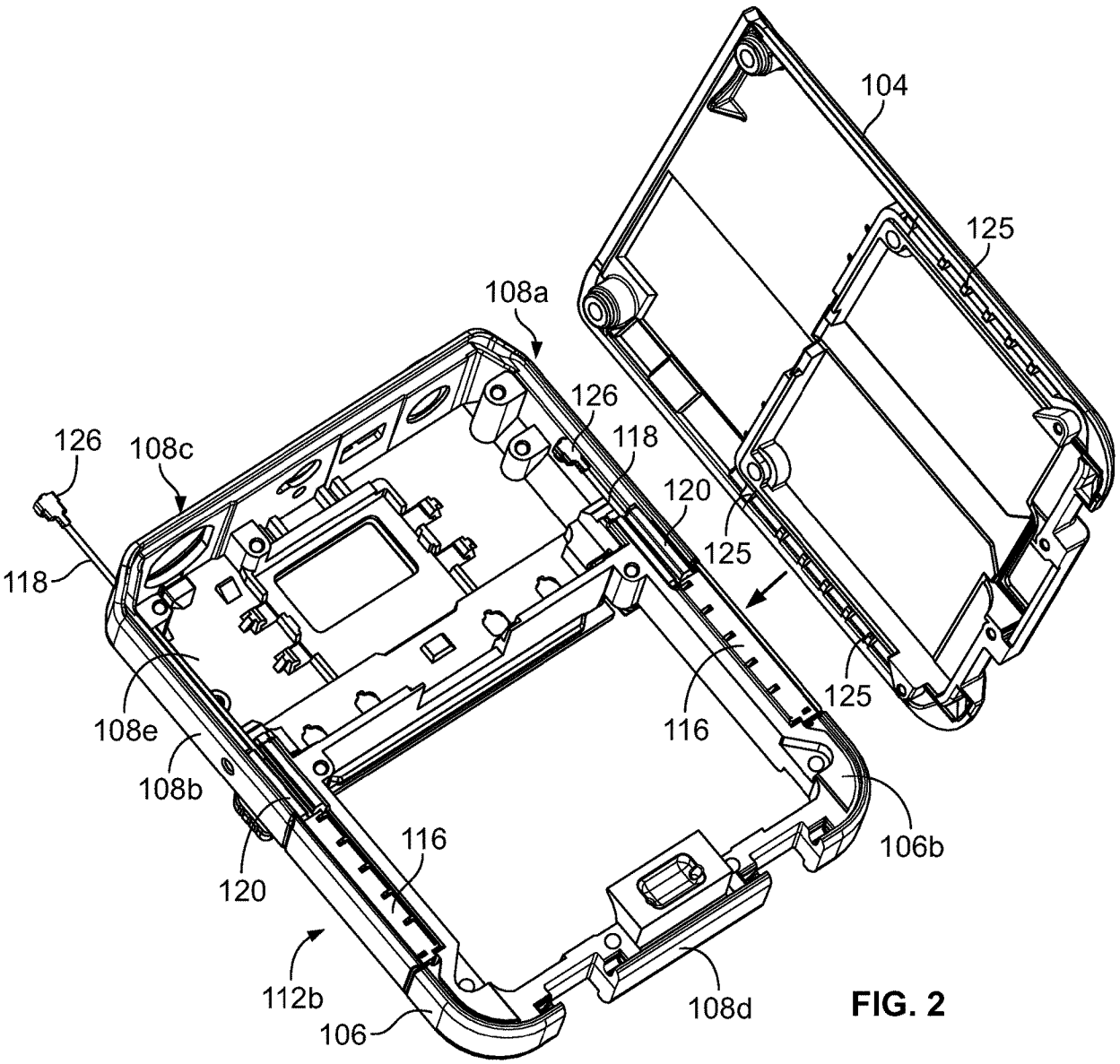
FIG. 2 is a partially exploded rear perspective view of an example frame and an example back cover of the portable wireless bodypack device of FIG. 1, in accordance with certain embodiments.
Figure 3:
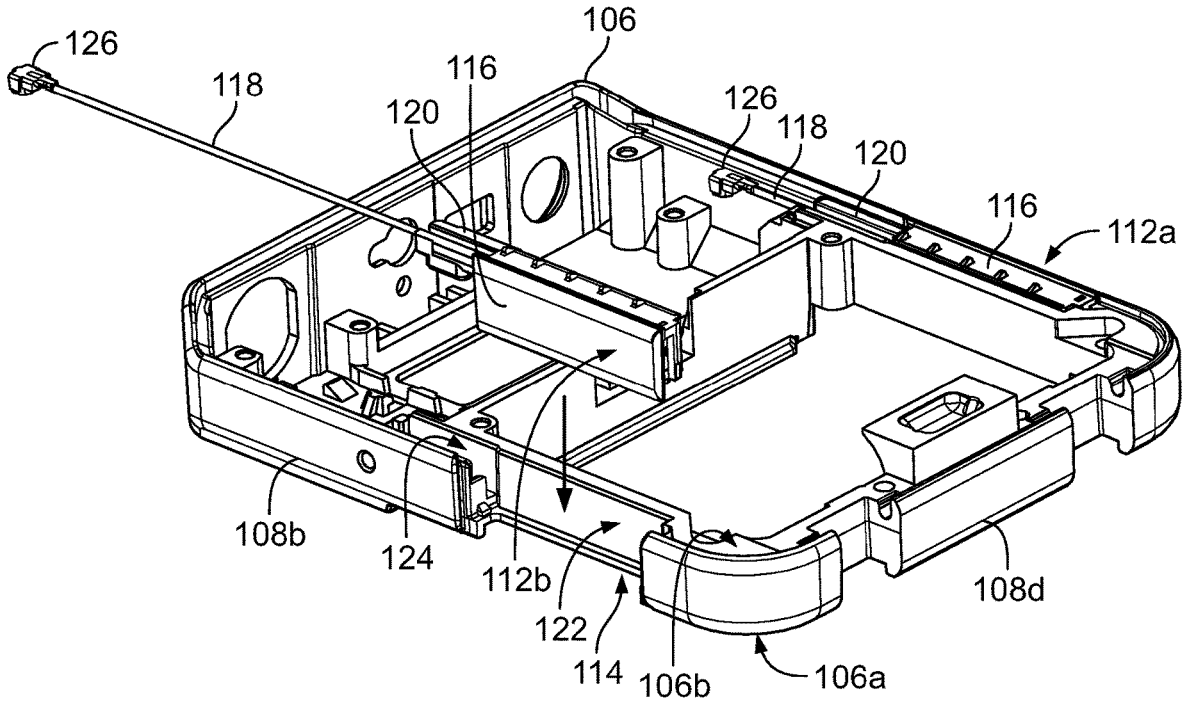
FIG. 3 is a partially exploded rear perspective view of the frame shown in FIG. 2 and two example antenna assemblies coupled to the frame, in accordance with certain embodiments.

Referring additionally to FIGS. 2 and 3, shown are rear perspective views of the frame 106 of the bodypack device 100, in accordance with embodiments. The front cover 102 can be coupled to a front surface 106*a* of the frame 106, below the upper front surface portion 108*e*, and the back cover 104 can be coupled to a back surface 106*b* of the frame 106, as shown in FIG. 2. Accordingly, the front cover 102 and the back cover 104 can be separated from each other by a width of the frame 106, as shown in FIG. 1.

Figure 4:
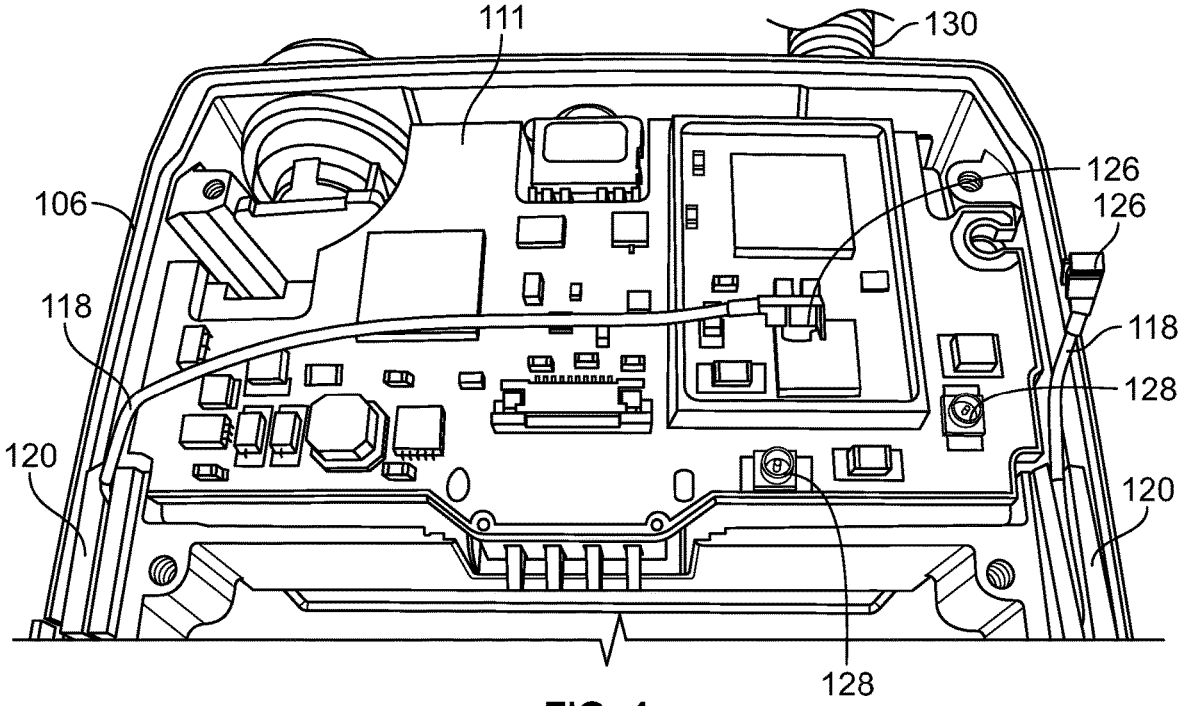
FIG. 4 is a partial front view of example internal circuitry components coupled to the frame shown in FIG. 2, in accordance with certain embodiments.

In embodiments, the front cover 102, the back cover 104, and the frame 106 join together to form an enclosure for housing various electrical components of the bodypack device 100. For example, referring additionally to FIG. 4, shown is an example circuit board 111 comprising the various electrical components of the bodypack device 100, including circuitry for the display screen, a power source, a wireless communication unit, and one or more audio components. As illustrated, the circuit board 111 can be positioned in the frame 106 between upper front surface portion 108*e* and the back cover 104. According to embodiments, the circuit board 111 can be any type of circuit board, including, for example, a printed circuit board, as shown in FIG. 4.

As shown in FIGS. 1-4, the bodypack device 100 further includes a set of antenna assemblies 112*a* and 112*b* that are arranged on opposite sidewalls 108*a* and 108*b* of the device 100. In embodiments, the antenna assemblies 112*a* and 112*b* are configured to be fully integrated or embedded into the enclosure of the bodypack device 100, so as to maintain an existing form factor of the bodypack device 100. For example, as shown in FIGS. 1A and 1B, each antenna assembly 112*a*, 112*b* forms a portion of, and/or is flush with, the corresponding sidewall 108*a*, 108*b*. In addition, as shown in FIGS. 2 and 3, the antenna assemblies 112*a* and 112*b* are configured to fit completely within corresponding slots 114 included in the respective sidewalls 108*a* and 108*b*, so as to not occupy any space on an exterior of the bodypack device 100. In embodiments, due at least to the conformal structure and symmetrical placement of the antenna assemblies 112*a* and 112*b* in opposing sidewalls 108*a* and 108*b*, the antenna assemblies 112*a* and 112*b* can be configured to be mirror images of each other, as shown in FIGS. 2 and 3.

More specifically, each antenna assembly 112*a*, 112*b* includes an antenna housing 116 configured to enclose an antenna element (such as, e.g., antenna element 202 in FIG. 7), an electrical cable 118 having a first end coupled to the antenna element inside the antenna housing 116 and a second end extending out from the antenna housing 116, and a conductive gasket 120 coupled to the electrical cable 118 adjacent to and outside the antenna housing 116. As shown in FIG. 3, the slot 114 for receiving a corresponding antenna assembly 112*a*, 112*b* in the respective sidewall 108*a*, 108*b* includes an external opening 122 for receiving the antenna housing 116 and an internal channel 124 for receiving the electrical cable 118 and the conductive gasket 120. The internal channel 124 extends from a top end of the external opening 122 and runs along an interior of the corresponding sidewall 108*a*, 108*b* towards the top side 108*c* of the bodypack device 100. The external opening 122 forms a break in the corresponding sidewall 108*a*, 108*b* and has a width substantially equal to a width of the corresponding sidewall 108*a*, 108*b*.

In embodiments, a width, depth, and overall shape of the antenna housing 116 can be configured according to a width, depth, and shape of the external opening 122, so that the antenna housing 116 conforms to or fills the entire opening 122. For example, as shown in FIGS. 1-3, an outer wall of the antenna housing 116 can mesh with an exterior wall of the bodypack device 100, or more specifically, form a portion of the respective external sidewall 108*a*, 108*b*, and the front and back sides of the antenna housing 116 can be substantially flush with the front surface 106*a* and back surface 106*b*, respectively, of the frame 106.

Also in embodiments, a width, depth, and overall shape of the conductive gasket 120 can be configured according to a width, depth, and shape of the internal channel 124, respectively, so that the conductive gasket 120 fits snugly into the internal channel 124 and around the cable 118. In some embodiments, the conductive gasket 120 is made from a compressible material, such as rubber, that enables the sides of the conductive gasket 120 to be compressed as the gasket 120 is pressed into the internal channel 124, so as to create a hermetic seal between the conductive gasket 120 and the internal channel 124. In some embodiments, the conductive gasket 120 is further compressed into the internal channel 124 upon placement of the back cover 104 over the frame 106, for example, due to pressure applied by one or more ribs 125 along the interior edges of the back cover 104, as shown in FIG. 2.

As shown in FIG. 4, the electrical cables 118 can be configured to electrically connect the antenna assemblies 112*a* and 112*b* to the circuit board 111. For example, each electrical cable 118 can include a plug 126 (e.g., an MHF plug) coupled to the cable 118 opposite the antenna housing 116, and the circuit board 111 can include corresponding connectors 128 (e.g., MHF receptacles) for receiving the plugs 126. In embodiments, the electrical cable 118 can be a coaxial cable or other type of communication cable appropriate for carrying wireless signals between the antenna element of the antenna assembly 112 and the circuit board 111.

In embodiments, the bodypack device 100 can include an additional, external or whip antenna (e.g., a WIP antenna) coupled to a connector 130 (e.g., SMA connector) included on the top side 108*c* of the device 100 and electrically coupled to the circuit board 111. In one example embodiment, the external antenna can be configured for operation in a licensed UHF band, and the antenna assemblies 112*a* and 112*b* can be configured for diversity operation in the 2.4 Gigahertz (GHz) band (e.g., for control link signals). In other embodiments, the antenna assemblies 112*a* and 112*b* and/or the external antenna can be configured for operation in any of the following frequency bands: 1.5 GHz, 1.8 GHz (which includes the 1.9 GHz or "DECT" band), 2.4 GHz (such as, e.g., the Zigbee band), 5.7 GHz, 6.9 GHz, and 7.1 GHz. As will be understood by one of ordinary skill in the art, each of these frequency bands covers or includes a range of frequencies surrounding the named frequency.

The function of the external antenna can vary depending on the type of bodypack device 100. For example, in the case of a wireless bodypack microphone transmitter, the external antenna can be configured to receive wireless signals from a wireless microphone, while the antenna assemblies 112*a* and 112*b* can be configured to transmit the received wireless signals to a remote receiver. As another example, in the case of a wireless bodypack personal monitor receiver, the antenna assemblies 112*a* and 112*b* can be configured to receive wireless signals from a remote transmitter, while the external antenna can be configured to transmit the received wireless signals to a wireless personal monitor.

In embodiments, the placement of the antenna assemblies 112*a*, 112*b* on respective sidewalls 108*a*, 108*b* can be configured to maximize a distance between the antenna elements included in each assembly 112 and the external antenna, and/or the connector 130 coupled thereto. For example, as shown in FIG. 1A, a bottom end of each antenna assembly 112*a*, 112*b* (and therefore, a bottom end of the antenna element included therein) can be positioned closer to the bottom side 108*d* of the frame 106 than to the top side 108*c*, which includes the external antenna connector 130. In embodiments, the distance between the external antenna and each antenna assembly 112*a*, 112*b* can be selected to help minimize undesirable interactions between the operational frequency bands of each antenna, such as, for example, generation of intermodulation products, receiver overloading effects, etc.

According to embodiments, each of the front cover 102, the back cover 104, and the frame 106 can be made from a sturdy, conductive material, such as metal, to provide radio frequency (RF) shielding for the internal components of the device 100. The antenna housing 116, on the other hand, can be made of a non-conductive material, such as plastic, to facilitate wireless communication via the antenna element included in the antenna housing 116. As will be appreciated, antenna detuning can occur when an antenna element is placed in close proximity to conductive or metal parts and/or placed on or near a human body. In embodiments, the non-conductive antenna housing 116 can be arranged within the conductive enclosure of the bodypack device 100 so as to minimize this antenna detuning and achieve high antenna efficiency, as well as, for example, minimize RF interference between the antenna within the antenna housing 116 and the internal circuitry included on the circuit board 111 and/or mitigate RF link failure caused by interference between the antennas of the bodypack device 100.

For example, as shown in FIGS. 1A and 1B, each antenna assembly 112*a*, 112*b* can be centered on the corresponding sidewall 108*a*, 108*b* between the front cover 102 and the back cover 104 of the device 100. This arrangement of the antenna assemblies 112*a* and 112*b* utilizes the conductive covers 102 and 104 to, for example, maximize a spatial isolation of the antenna elements from human body interference, which can mitigate the effects of human body detuning and improve antenna efficiency.

In addition, as shown in FIGS. 2 and 3, each non-conductive antenna housing 116 can be encased within the respective sidewall 108*a*, 108*b* of the conductive frame 106 on the top, bottom, and inner sides, and between the conductive front and back covers 102 and 104 on the front and back sides, with the remaining side of the housing 116 facing an exterior of the bodypack housing 100. This arrangement of the antenna housings 116 within the conductive enclosure of the bodypack device 100 shields the internal circuitry of the bodypack device 100 from any RF interference conducted and/or radiated by the antenna elements of the antenna housings 116.

As also shown in FIGS. 2 and 3, the antenna assemblies 112*a* and 112*b* can be arranged within opposite sidewalls 108*a* and 108*b*, respectively, so that the antenna elements therein are separated by the entire width of the bodypack device 100. This arrangement provides, for example, maximum spatial separation of the antenna elements, while still keeping the antenna assemblies 112*a* and 112*b* completely integrated into the bodypack device 100. Due to this physical separation, the antenna elements can operate as diversity antennas that cover the same or similar RF bands (e.g., 1.5 GHz, 1.8 GHz, 2.4 GHz (e.g., the Zigbee band), 5.7 GHz, 6.9 GHz, 7.1 GHz, etc.) with maximum diversity gain and without generating undesirable effects, such as, for example, intermodulation products. Such spatial diversity can also help prevent, or reduce the probability of, RF link failure, at least because the antennas can serve as back-ups for each other in the event of failure by one of the antennas due to, for example, human body detuning.

Figure 5:
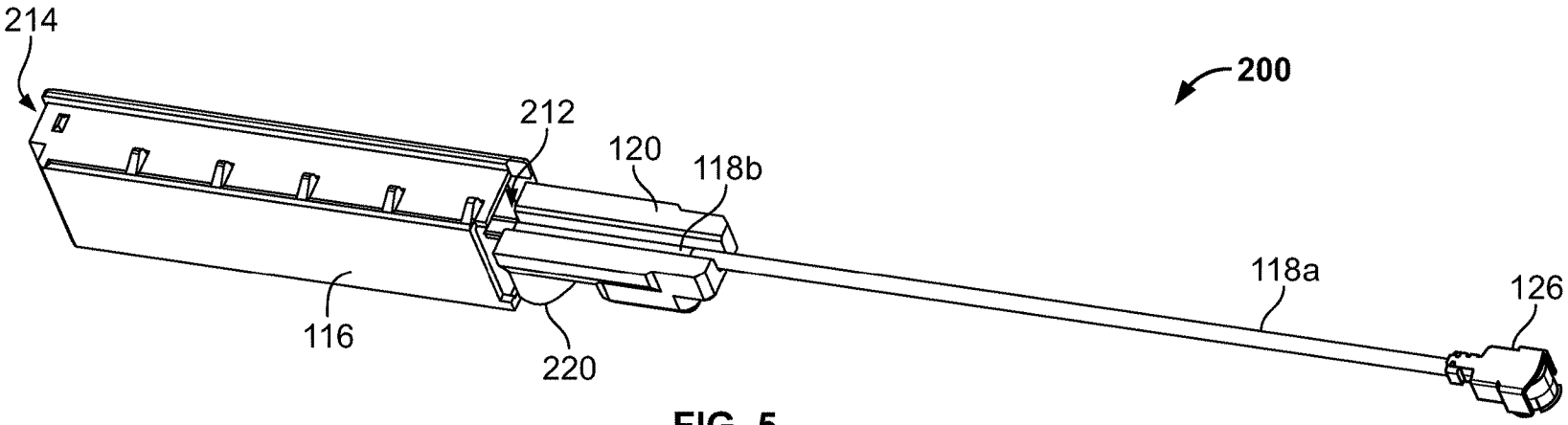
FIG. 5 is a top perspective view of an example antenna assembly, in accordance with certain embodiments.
Figure 6:
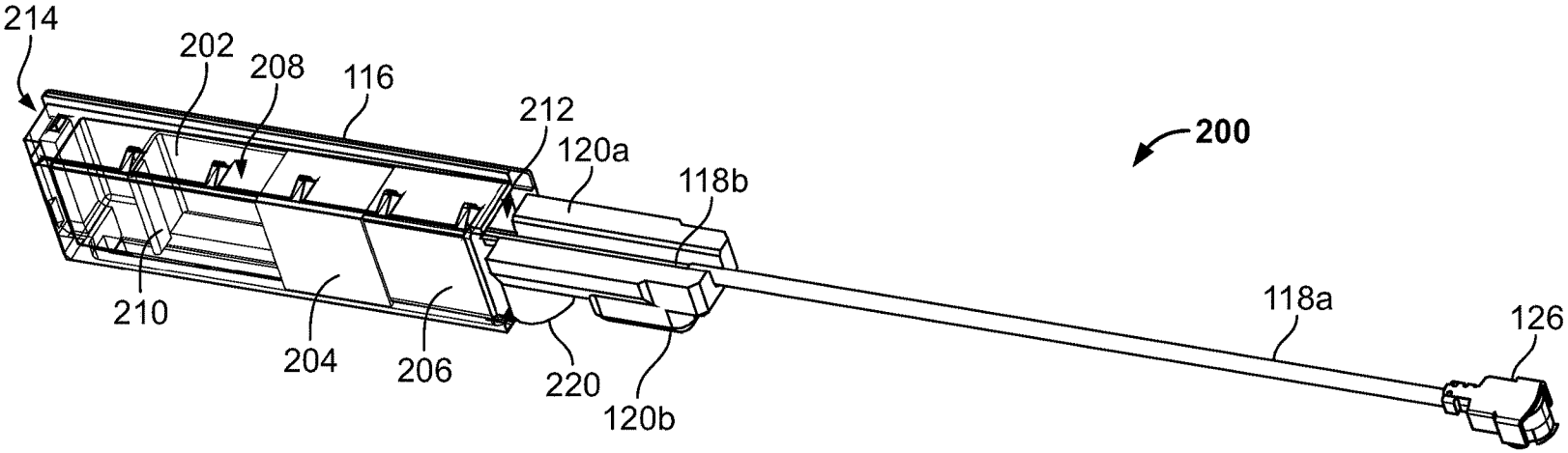
FIG. 6 is a partially transparent top perspective view of the antenna assembly shown in FIG. 5, in accordance with certain embodiments.

FIGS. 5 and 6 illustrate an example antenna assembly 200 configured for insertion into the frame 106 shown in FIGS. 2 and 3, in accordance with embodiments. In the illustrated embodiments, the antenna assembly 200 is similar to the antenna assembly 112*b* shown in FIG. 3 and includes the antenna housing 116, the electrical cable 118, the conductive gasket 120, and the electrical plug 126 described herein with respect to the antenna assemblies 112*a* and 112*b*. FIG. 5 depicts the antenna assembly 200 as fully assembled and ready for insertion into the frame 106. FIG. 6 depicts the antenna assembly 200 with a partially transparent antenna housing 116 for ease of illustration and to facilitate description of the components inside the antenna housing 116. It should be appreciated that, although the embodiments of the antenna assembly 200 described herein are explained in the context of the antenna assembly 112*b*, the same techniques can be used to implement the antenna assembly 112*a* by producing a mirror image of the antenna assembly 200.

As shown in FIG. 6, the antenna housing 116 fully encases an antenna element 202 and one or more dielectric materials, such as, for example, a first dielectric portion 204, a second dielectric portion 206, and/or a third dielectric portion 208, in accordance with embodiments. The one or more dielectric materials are preferably low loss, dielectrically-loaded materials selected to achieve high antenna efficiency for the antenna element 202. For example, the one or more dielectric materials may provide a higher dielectric constant, alone or in combination with each other, that can compensate for an electrically short antenna element 202, or otherwise increase the electrical length of the antenna element 202.

In embodiments, the first dielectric portion 204 is a foam pad made of, for example, PORON® or other suitable electrically conductive foam. The second dielectric portion 206 is made from an epoxy or epoxy resin, such as, for example, a Flex Epoxy manufactured by Sigma Plastronics, or any other suitable epoxy material. And the third dielectric portion 208 comprises air or other suitable dielectric material. As shown in FIG. 6, the first dielectric portion 204 (also referred to herein as the "foam portion") can be positioned adjacent to the antenna element 202 and between the second dielectric portion 206 (also referred to herein as the "epoxy portion") and the third dielectric portion 208 (also referred to herein as the "air portion"). As also shown, the third dielectric portion 208 can be positioned between the foam portion 204 and an inner end 210 of the antenna element 202, and the epoxy portion 206 can be positioned between the foam portion 204 and an open end 212 of the antenna housing 116. In embodiments, the epoxy portion 206 can be configured to environmentally seal the open end 212 of the antenna housing 116, while an opposite end 214 of the antenna housing 116 can be fully closed, thereby providing the antenna element 202 with protection from moisture, debris, and other external factors on both ends.

In embodiments, the antenna assembly 200 can be assembled in multiple stages that are designed to preserve the structural integrity and electrical properties of the antenna element 202. For example, FIGS. 7-10 illustrate various stages of fabrication during an example process for manufacturing the antenna assembly 200, in accordance with embodiments. The manufacturing process may be performed at one facility or at multiple facilities. For example, in some cases, one or more steps may be performed at a pre-fabrication facility, and the remaining steps may be performed at a finishing facility.

Figure 7:
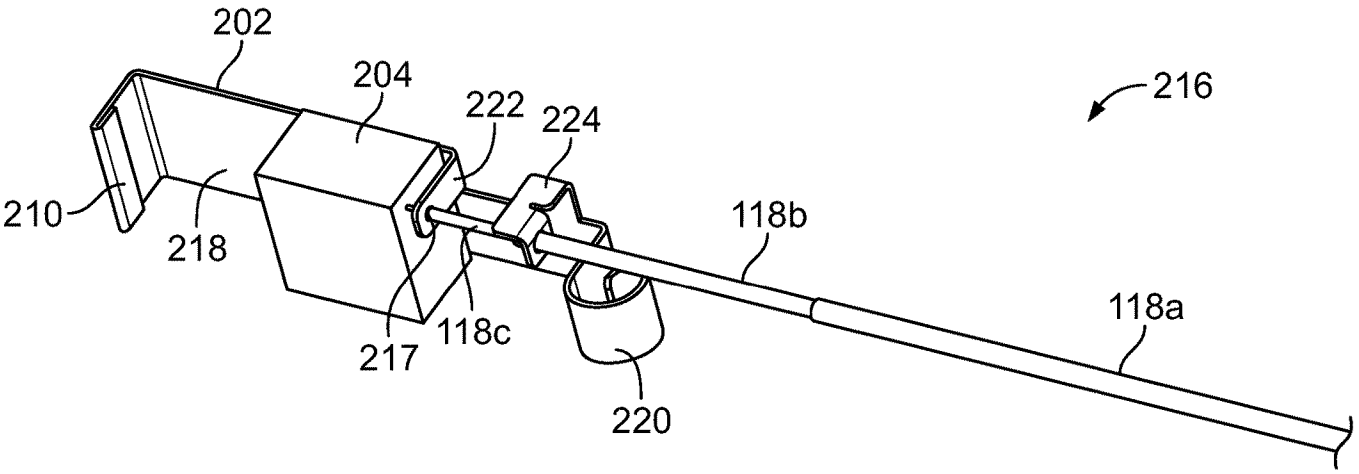
FIG. 7 is a close-up view of a first subassembly included in the antenna assembly shown in FIG. 5, in accordance with certain embodiments.

Referring initially to FIG. 7, shown is an example first subassembly 216 of the antenna assembly 200, in accordance with embodiments. As shown, the first subassembly 216 includes the antenna element 202, the foam portion 204, and the electrical cable 118. In embodiments, the first end of the electrical cable 118 may be coupled to the antenna element 202 at a connection point 217 that also serves as a feed point of the antenna 202, and the foam portion 204 may be adhered to the antenna element 202 adjacent to the feed point 217. The antenna element 202 can be formed from one or more sheets of metal, or other suitable conductive material, using known metal forming techniques. According to embodiments, the antenna element 202 can be configured to be any suitable type of antenna, such as, e.g., an inverted-F antenna, planar inverted-F antenna (PIFA), modified inverted-F antenna, inverted-L antenna, dual inverted-L antenna, or hybrids of these antenna structures. In addition, the antenna 202 can be configured to cover any desired operating band, including, for example, the 1.5 GHz, the 1.8 GHz band, the 2.4 GHz band, the 5.7 GHz band, the 6.9 GHz band, and/or the 7.1 GHz band, for transmission and/or reception of audio signals, data signals, and/or control link signals.

As shown in FIG. 7, the antenna element 202 (also referred to herein as an "antenna") includes an elongated main body 218 that extends between the inner end 210 and an opposing outer end 220, and one or more structures that are formed from or extend off of the main body 218. For example, in the illustrated embodiment, the inner end 210 of the antenna 202 extends perpendicularly from the main body 218 of the antenna 202 to form an "L-shaped" structure or leg that substantially spans the width of the antenna housing 116. The outer end 220 of the antenna 202 extends perpendicularly from the main body 218 as well, but also curves back around to form a spiral-like structure, as shown in FIG. 7. In addition, the antenna element 202 includes a feed structure 222 and a base structure 224, both extending perpendicularly from the main body 218 of the antenna 202 and being configured for attachment to the electrical cable 118.

As shown, the electrical cable 118 extends through the base structure 224 and ends upon connection to the feed structure 222 at the feed point 217. In embodiments, the electrical cable 118 can be a micro-coaxial cable or other communication cable having a non-conductive outer sleeve 118*a* (also referred to as a "plastic jacket") covering an inner shield 118*b* (also referred to as a "metallic braid") which, in turn, covers a conductive core 118*c* (also referred to as a "center conductor"). As depicted in FIG. 7, certain portions of the electrical cable 118 may be trimmed to expose the inner shield 118*b* and/or the conductive core 118*c* of the cable 118 to provide an electrical connection between the cable 118 and the antenna element 202. For example, the inner shield 118*b* may be exposed in the portion of the cable 118 that is coupled to an exterior of the base structure 224 and extends towards the plug 126, and is substantially covered by the conductive gasket 120, as shown in FIG. 6. In such cases, the inner shield 118*b* may be soldered to the exterior of the base structure 224. The conductive core 118*c* may be exposed in the portion of the cable 118 that extends between the structures 222 and 224. In such cases, the conductive core 118*c* may be soldered to the feed structure 222 at the connection point 217, thus providing the antenna feed point.

In embodiments, the size, shape, and configuration of the main body 218, as well as the one or more structures 210, 220, 222, and 224, can be configured to implement the desired type of antenna, achieve a desired antenna length, provide appropriate impedance matching, or otherwise optimize antenna performance in the desired frequency band(s), and/or conform the antenna element 202 to the geometry of the slot 114 within the respective sidewall 108*a*, 108*b* (or other space available for the antenna assembly 200 inside the frame 106). For example, a width and length of the main body 218 can be selected based on a depth and length of the slot 114 shown in FIG. 3, while the overall shape of the antenna element 202 can be selected to achieve a desired antenna length and type. As another example, a distance between the base structure 224 and the feed structure 222 can be selected to optimize the impedance matching for the antenna 202.

Figure 11:
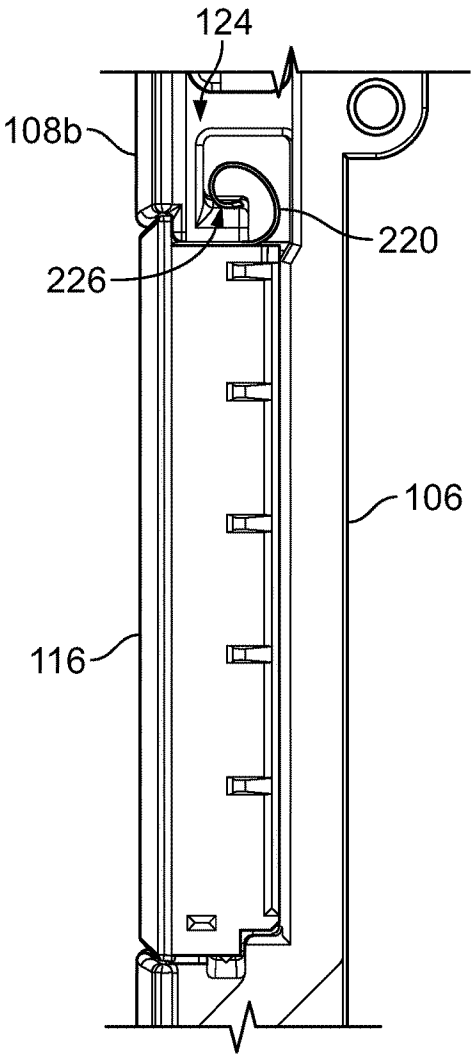
FIG. 11 is a close-up view of a portion of the antenna assembly installed in the frame of FIG. 2, in accordance with certain embodiments.

As yet another example, in embodiments, the spiral structure of the outer end 220 can be configured according to a shape or configuration of the internal channel 124 that receives the outer end 220 of the antenna 202 when the antenna assembly 200 is placed into the frame 106. In embodiments, the shape and placement of the outer end 220 can also be configured to create a grounding element for the antenna 202. In such cases, the outer end 220 may operate as a spring finger or metal clip designed to provide antenna grounding. To illustrate, FIG. 11 depicts the antenna assembly 200 coupled to the sidewall 108*b* of the frame 106, but with the conductive gasket 120 and the electrical cable 118 removed in order to reveal the outer end 220 of the antenna 202. As shown, the outer end 220 fits into a recess of the internal channel 124 and curves around so as to fill the recess but avoid contact with the walls of the recess, except for a contact wall 226. As also shown, a planar portion of the outer end 220 also touches an opposite side of the contact wall 226. According to embodiments, these two contacts between the outer end 220 and the contact wall 226 of the conductive frame 106 can create a grounding post during operation of the antenna element 202. Placement of the outer end 220 into the recess of the internal channel 124 can also help hold the antenna assembly 200 in place and/or prevent the antenna assembly 200 from moving within the slot 114.

Figure 8:
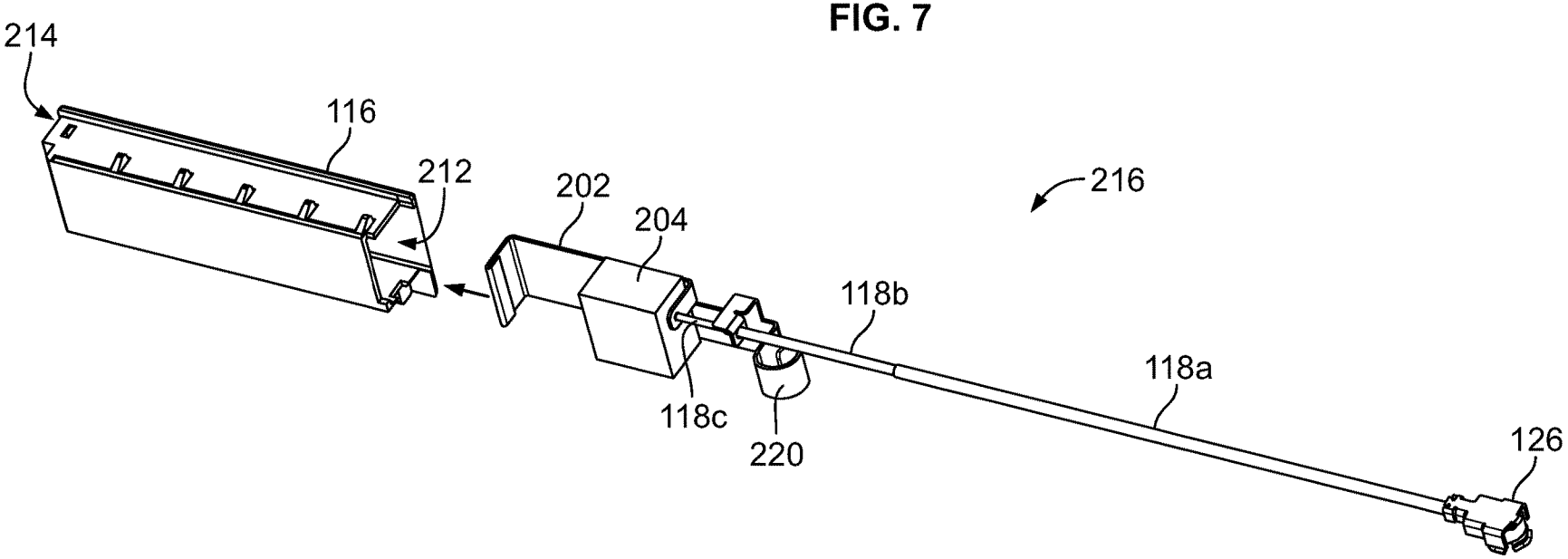
FIG. 8 is a perspective view of the first subassembly of FIG. 7 and an antenna housing of the antenna assembly of FIG. 5 during a first stage of fabrication, in accordance with certain embodiments.
Figure 9:
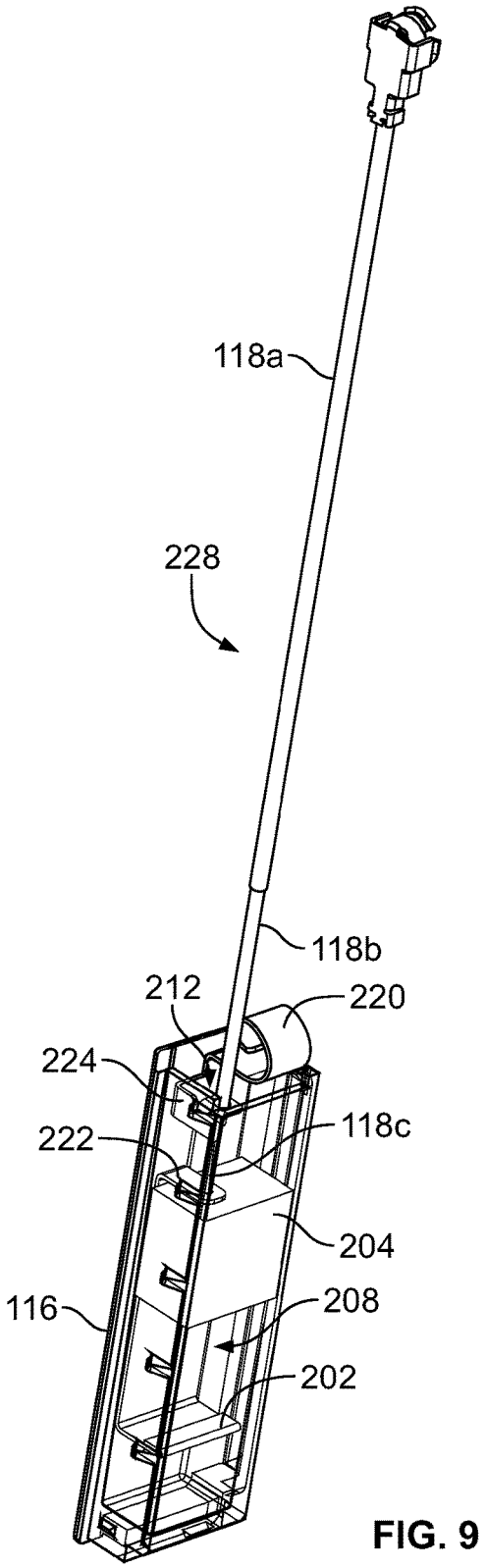
FIG. 9 is a partially transparent view of a second subassembly of the antenna assembly of FIG. 5 during a second stage of fabrication, in accordance with certain embodiments.

Referring now to FIG. 8, shown is the first subassembly 216 and the antenna housing 116 during a first stage in the process for manufacturing the antenna assembly 200, in accordance with embodiments. During the first stage, the first subassembly 216 is inserted into the antenna housing 116 to form a second subassembly 228 (shown in FIG. 9). As shown in FIG. 6, the first subassembly 216 is not fully inserted into the antenna housing 116. Rather, at least the outer end 220 remains outside of the antenna housing 116, as shown in FIG. 9. In embodiments, the foam pad 204 can be configured to align the antenna element 202 within the antenna housing 116 and/or against the inside of the housing 116. For example, the foam pad 204 can have a size and shape that is configured to fit snugly against the inside of the antenna housing 116 and therefore, can prevent the antenna element 202 from moving around or being jostled while inside the housing 116. In some cases, the foam pad 204 may be at least slightly compressed as the subassembly 216 is slid into the housing 116 in order to form a tight seal between the foam pad 204 and the inside of the housing 116.

Figure 10:
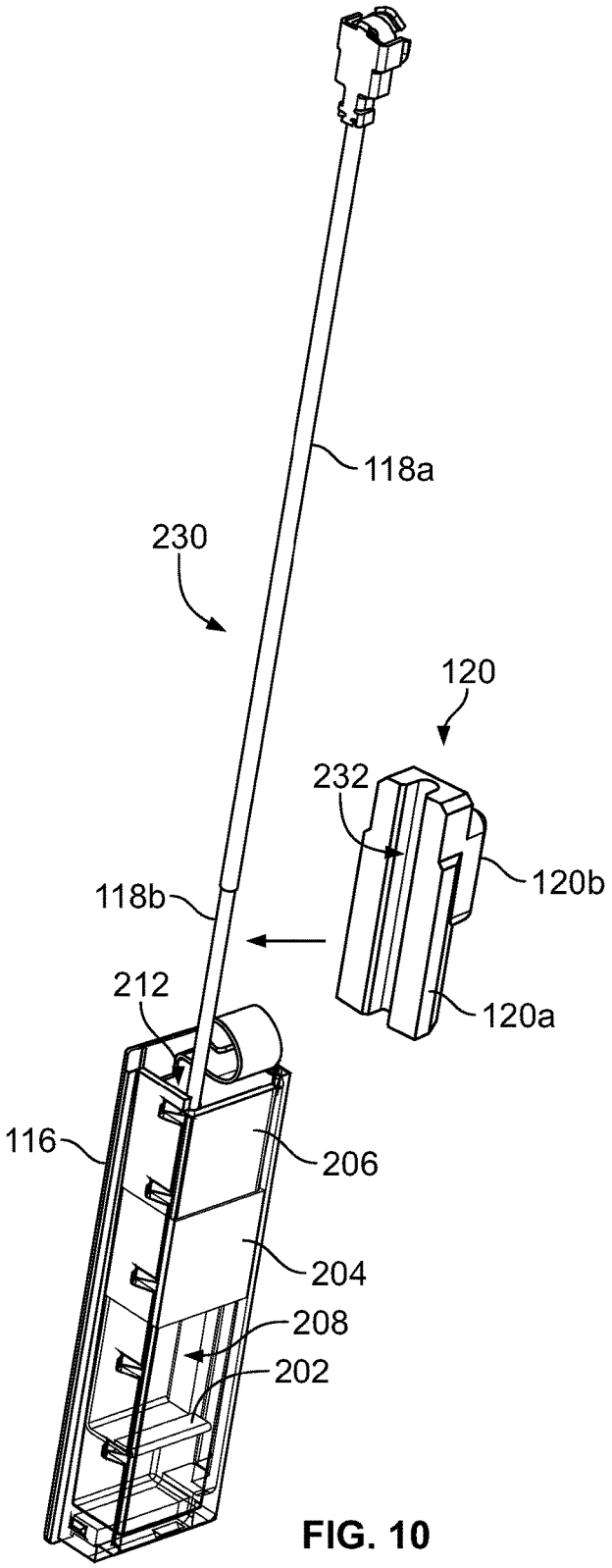
FIG. 10 is a partially transparent view of a third subassembly and a conductive gasket of the antenna assembly shown in FIG. 5 during a third stage of fabrication, in accordance with certain embodiments.

FIG. 9 illustrates the second subassembly 228 during a second stage in the process for manufacturing the antenna assembly 200, in accordance with embodiments. During the second stage, the epoxy material (not shown) is dispensed into the open end 212 of the antenna housing 116 to form the epoxy portion 206 of the antenna assembly 200. For example, the epoxy material may be deposited into the housing 116 in a liquid or spreadable form and then hardened or set into place, for example, using a curing process. In embodiments, the foam pad 204 can be configured to serve as a base for limiting a downward flow of the epoxy material, for example, by forming a liquid-proof seal with the side walls of the antenna housing 116. In such cases, the epoxy portion 206 may be formed by completely filling the space between the foam pad 204 and the open end 212 of the antenna housing 116 with the epoxy material, for example, as shown in FIG. 10. Once the epoxy portion 206 is formed, the structures 222 and 224, or more specifically, the two points of connection between the cable 118 and the antenna element 202, may be potted within the epoxy material, and the open end 212 of the antenna housing 116 may be environmentally sealed by the epoxy material.

FIG. 10 illustrates a third subassembly 230 during a third stage in the process for manufacturing the antenna assembly 200, in accordance with embodiments. As shown, the third subassembly 230 includes the second subassembly 228 with the epoxy portion 206 in place. During the third stage, the conductive gasket 120 is coupled to the third subassembly 230 by inserting the inner shield 118*b* of the electrical cable 118 into a central slot 232 of the conductive gasket 120. In embodiments, the conductive gasket 120 can be made of conductive rubber (such as, e.g., a conductive elastomer manufactured by Chomerics®) or other suitable compressible material that includes metal or other conductive pieces therein. The size and shape of the conductive gasket 120 may be configured to fit around or onto the third subassembly 230 and/or into the internal channel 124 of the frame 106. For example, as shown in FIG. 6, a first portion 120*a* of the conductive gasket 120 may be configured to rest above, or be supported by, the metal clip formed at the outer end 220. And a second portion 120*b* of the conductive gasket 120 may be configured to extend down past the first portion 120*a*, so that a bottom side of the second portion 120*b* contacts the frame 106 when the antenna assembly 200 is inserted into the internal channel 124. Once the third stage is completed, the antenna assembly 200 is fully assembled, for example, as shown in FIG. 5, and ready for insertion into the frame 106.

In embodiments, the conductive gasket 120 can be configured to serve as a secondary grounding element for the antenna 202, in addition to the metal clip formed by the outer end 220 of the antenna 202. In particular, the central slot 232 of the gasket 120 may be sized and shaped to securely fit around and/or contact the inner shield 118*b* on at least three sides. In addition, the sides of the central slot 232 may become further compressed around the inner shield 118*b* as the gasket 120 is pressed into the internal channel 124 of the frame 106. Due to the electrical properties of both the conductive gasket 120 and the inner shield 118*b*, this compressed contact between the metal braid of the shield 118*b* and the conductive rubber of the gasket 120, and the surrounding contact between the conductive gasket 120 and the internal channel 124, can provide an electrical ground path between the frame 106 and the inner shield 118*b*, thus forming the secondary antenna ground. In embodiments, the compressed contact between the conductive gasket 120 and the inner shield 118*b* also protects the inner shield 118*b* from RF interference and reduces noise.

Figure 13:
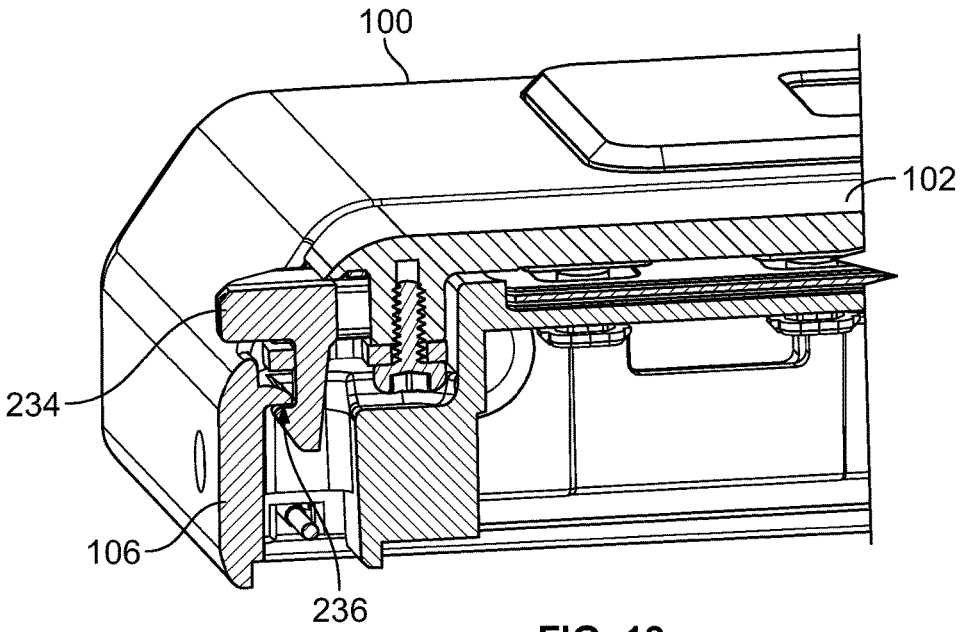
FIG. 13 is a cross-sectional view of the portable wireless bodypack device shown in FIG. 12, in accordance with certain embodiments.
Figure 14:
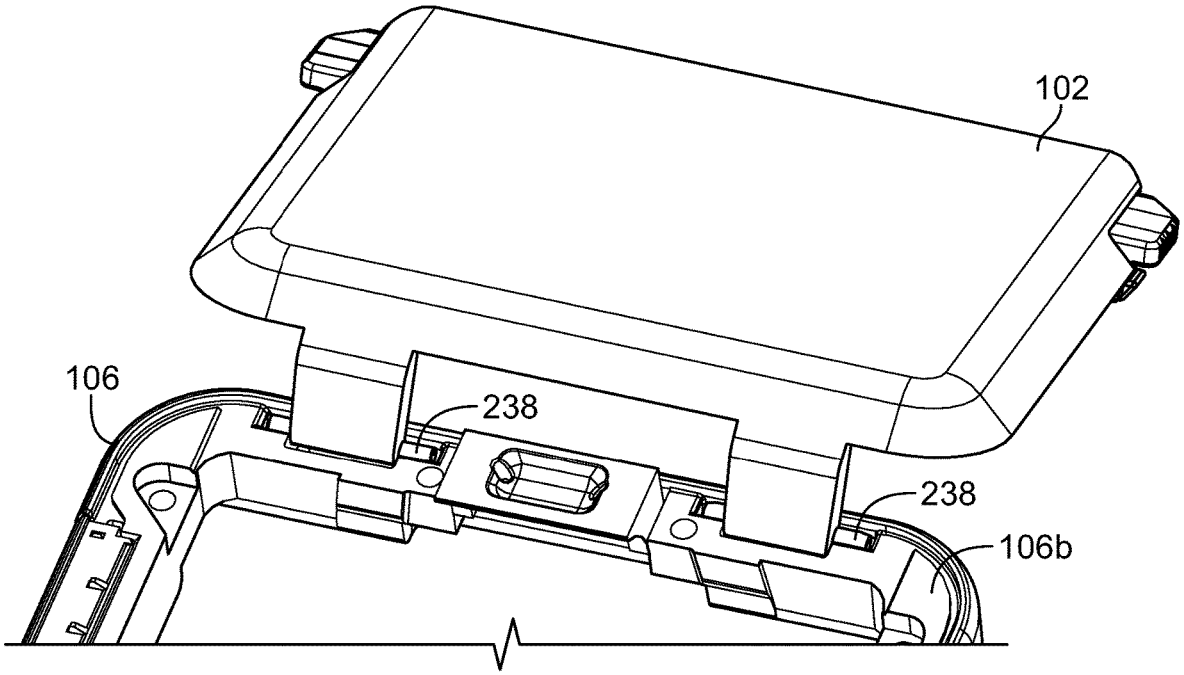
FIG. 14 is a perspective view of a portion of the frame shown in FIG. 3 and an example front cover coupled thereto, in accordance with certain embodiments.

In some embodiments, other components of the portable wireless bodypack device 100 can help further improve performance of the antenna assembly 200, for example, by ensuring a mechanical accuracy of the antenna assembly 200 and/or providing additional grounding points for the antenna 202 to help suppress or minimize any parasitic resonances (e.g., capacitance and/or inductance) resulting from the bodypack device 100. For example, when the back cover 104 is secured to the frame 106, the one or more ribs 125 on the inside edges of the back cover 104 may press the antenna assembly 200 into place and help keep the antenna assembly 200 secure during jerking or other movement of the device 100. As another example, FIGS. 12-14 show additional ground locations that are formed by the front cover or door 102 and certain points of connection with the conductive frame 106 and are configured to help avoid parasitic resonances from the device 100, in accordance with embodiments.

Figure 12:
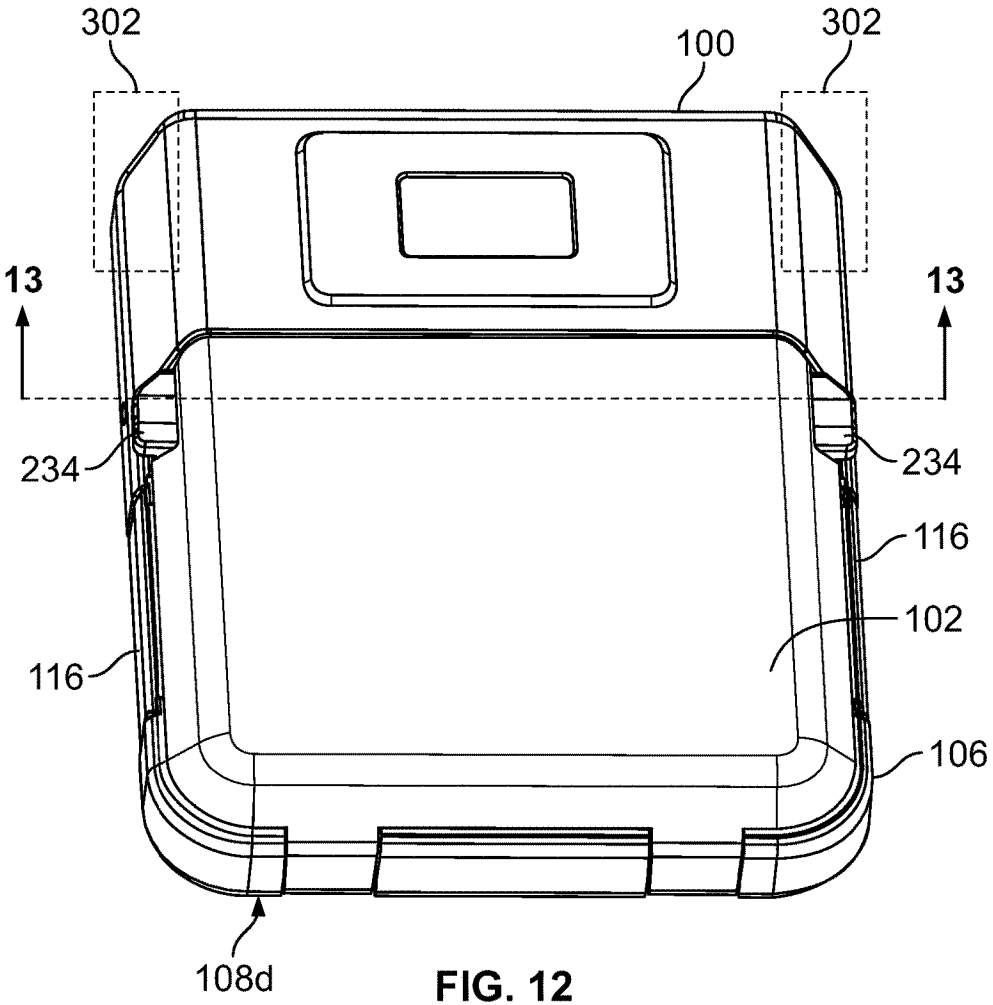
FIG. 12 is a top perspective view of the portable wireless bodypack device shown in FIG. 1, in accordance with certain embodiments.

In particular, FIG. 12 shows that the front door 102 can be secured to the frame 106 using a pair of latches 234 positioned on opposite sides of the door 102. In embodiments, the latches 234 are made of metal or other conductive material. FIG. 13 provides a partial cross-sectional view of one side of the bodypack device 100, and shows that each latch 234 makes contact with, or latches onto, the conductive frame 106 at a point 236. In embodiments, these points of contact 236 between the conductive latches 234 of the door 102 and the conductive frame 106 on each side of the device 100 can form solid electrical contacts that provide additional ground locations for the antenna 202, and thereby help suppress parasitic resonances from the bodypack device 100. Similarly, FIG. 14 shows that the front door 102 is coupled to the frame 106 by a pair of hinges 238. In embodiments, the hinges 238 are made of metal or other conductive material and include spring pins that secure the front door 102 to the bottom of the conductive frame 106 or the back surface 106*b*. The solid electrical contact between the hinges 238 and the frame 106 can form additional ground locations for the antenna 202 that also help avoid parasitic resonances of the bodypack device 100.

Figure 15:
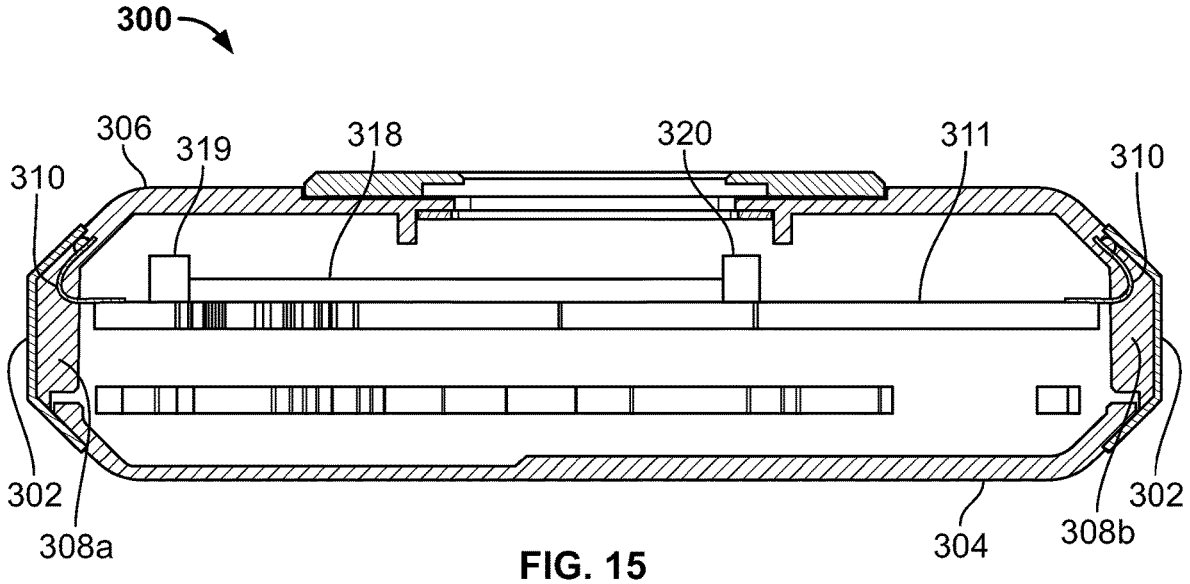
FIG. 15 is a cross-sectional view of another example portable wireless bodypack device with alternative antenna placement, in accordance with certain embodiments.

FIG. 15 illustrates a cross-sectional view of another example portable wireless bodypack device 300, in accordance with embodiments. The bodypack device 300 may be substantially similar to the bodypack device 100 shown in FIGS. 1A and 1B, except for the design and placement of diversity antennas 302. For example, the bodypack device 300 includes a front cover (not shown) and a back cover 304 coupled to a conductive frame 306 to form an enclosure for housing various electronic components, including a printed circuit board 311 and antennas 302. However, as shown in FIG. 12, the antennas 302 are positioned along a top portion of respective sidewalls 308 of the frame 306 and/or adjacent to opposing top corners of the device 300. In addition, as shown in FIG. 15, a shape of the antennas 302 is configured to conform to the three-panel shape of the sidewalls 308 and/or the frame 306. For example, the antenna 302 may be formed by bending or folding a sheet of metal into three panels, the center panel coinciding with the width of the sidewall 308*a*, 308*b* and the two side panels wrapping around the frame 306 on either side of the respective sidewall 308*a*, 308*b*. Moreover, instead of using electrical cables to connect the antennas to the circuit board, the antennas 302 may be electrically connected to the circuit board 311 using pogo pins or metal spring fingers 310 that are connected directly to the circuit board 311 (e.g., via soldering). In some cases, an electrical cable 318 may be used to connect an input point 319 of the antennas 302 to appropriate circuitry 320 on the board 311. In other cases, the circuitry 320 may be positioned on the circuit board 311 so that the cable 318 is not required. Accordingly, the antenna arrangement of the body pack device 300 may provide a mechanical structure that is simpler and easier to implement.

Thus, the embodiments described herein provide an enhanced portable wireless bodypack transmitter or receiver with diversity antennas strategically positioned on opposing sides of the bodypack housing to help minimize radio frequency (RF) link loss due to human body detuning. The diversity antennas can be configured for implementation in the 2.4 GHz band or other high frequency bands, such as, e.g., 1.5 GHz, 1.8 GHz, 5.7 GHz, 6.9 GHz, and/or 7.1 GHz. Moreover, the antenna assemblies included in the bodypack device are configured to be completely embedded into the conductive enclosure of the bodypack device and conform to existing space within the enclosure, or more specifically, a frame supporting the enclosure. In addition, the antenna assemblies have a unique mechanical design that is configured to provide stable antenna performance and minimum resonance frequency variation during manufacturing and assembly processes. For example, the assembly process can include inserting an antenna element subassembly into a mechanical enclosure (or plastic housing) and connecting an RF cable of the subassembly to the main circuit board of the bodypack device.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A portable wireless bodypack device, comprising:

a frame having a first external sidewall opposite a second external sidewall, each external sidewall including an outer surface and an opening within the outer surface formed by a recessed portion of the sidewall;

a first antenna housing disposed in the recessed portion of the first external sidewall and comprising a first antenna element; and a second antenna housing disposed in the recessed portion of the second external sidewall and comprising a second antenna element, wherein each antenna housing includes an enclosed antenna space defined by a plurality of adjoining sidewalls, the adjoining sidewalls comprising an external-facing wall configured to substantially fill the opening in the outer surface of the corresponding external sidewall.

2. The portable wireless bodypack device of claim 1, wherein a width of the opening in each external sidewall is substantially equal to a width of the outer surface of said sidewall.

3. The portable wireless bodypack device of claim 1, wherein each of the first and second antenna elements is positioned adjacent to the external-facing wall of the corresponding antenna housing to maximize a spatial separation between the two antenna elements.

4. The portable wireless bodypack device of claim 1, wherein each of the first and second external sidewalls includes the recessed portion in a bottom half of the sidewall.

5. The portable wireless bodypack device of claim 1, wherein the frame is made of a conductive material, and each of the first and second antenna housings is made of a non-conductive material.

6. The portable wireless bodypack device of claim 5, further comprising a conductive front cover coupled to a front surface of the frame and a conductive back cover coupled to a back surface of the frame.

7. The portable wireless bodypack device of claim 6, wherein each antenna housing has a first one of the plurality of adjoining sidewalls adjacent to the front cover and an opposing one of the plurality of adjoining sidewalls adjacent to the back cover.

8. The portable wireless bodypack device of claim 6, wherein each of the first and second antenna elements is centered on the corresponding external sidewall between the front cover and the back cover.

9. The portable wireless bodypack device of claim 1, further comprising:

a first electrical cable coupled to the first antenna element within the first antenna housing and a second electrical cable coupled to second antenna element within the second antenna housing, each electrical cable having an outer portion extending out from the corresponding antenna housing; and a first conductive gasket coupled to the outer portion of the first electrical cable and a second conductive gasket coupled to the outer portion of the second electrical cable.

10. The portable wireless bodypack device of claim 9, wherein each conductive gasket is configured to contact the frame along at least two sides of the gasket to provide antenna grounding.

11. The portable wireless bodypack device of claim 1, wherein each of the first and second antenna housings further comprises a closed bottom coupled to the sidewalls of the housing and an open top positioned opposite the closed bottom, the open top being configured to receive the corresponding antenna element during assembly.

12. The portable wireless bodypack device of claim 1, wherein each of the first and second antenna elements is configured for operation in at least one of the following frequency bands: 1.5 Gigahertz (GHz), 1.8 GHz, 2.4 GHz, 5.7 GHz, 6.9 GHz, and 7.1 GHz.

13. A portable wireless bodypack device, comprising:

a frame having a first external sidewall opposite a second external sidewall and a top external wall opposite a bottom external wall;

a first antenna housing disposed in the first external sidewall, the first antenna housing comprising a first antenna element;

a second antenna housing disposed in the second external sidewall, the second antenna housing comprising a second antenna element; and an external connector coupled to the top external wall of the frame, the external connector being configured for electrical connection to a third antenna disposed outside the frame, wherein the first and second antenna elements are configured for operation in a different frequency band than the third antenna connected to the external connector, and wherein the first and second antenna elements are positioned closer to the bottom external wall than the top external wall so as to minimize interactions between the frequency band of the third antenna and the frequency band of the first and second antenna elements.

14. The portable wireless bodypack device of claim 13, wherein a position of each antenna element within the corresponding external sidewall is selected to minimize cross-band coupling between the external connector and said antenna element.

15. The portable wireless bodypack device of claim 13, wherein each of the first and second external sidewalls includes a recess in a bottom half of said sidewall for receiving the corresponding antenna housing.

16. The portable wireless bodypack device of claim 13, wherein the first and second antenna elements are configured for diversity operation in one or more high frequency bands, and the third antenna is configured for operation in a low frequency band.

17. The portable wireless bodypack device of claim 13, wherein each of the first and second antenna elements is configured for operation in at least one of the following frequency bands: 1.5 Gigahertz (GHz), 1.8 GHz, 2.4 GHz, 5.7 GHz, 6.9 GHz, and 7.1 GHz.

18. The portable wireless bodypack device of claim 13, wherein each of the first and second antenna housings comprises an external-facing wall configured to form part of the corresponding external sidewall.

19. The portable wireless bodypack device of claim 13, wherein each of the first and second antenna elements is positioned adjacent to the external-facing wall of the corresponding antenna housing to maximize a spatial separation between the two antenna elements.

20. The portable wireless bodypack device of claim 13, wherein the frame is made of a conductive material, and each of the first and second antenna housings is made of a non-conductive material.

21. The portable wireless bodypack device of claim 13, wherein the frame has a generally rectangular shape formed by the top and bottom external walls being shorter in length than the first and second external sidewalls.

* * * * *